US011517072B2

(12) United States Patent
Borrillo et al.

(10) Patent No.: US 11,517,072 B2
(45) Date of Patent: Dec. 6, 2022

(54) ADAPTIVE ELECTROSTATIC DISCHARGE AND ELECTRIC HAZARD FOOTWEAR

(71) Applicant: International Business Machines Corporation, Armonk, NY (US)

(72) Inventors: Steven Chandler Borrillo, Rochester, MN (US); Eric J. Campbell, Rochester, MN (US); Jennifer I. Bennett, Rochester, MN (US); Sarah K. Czaplewski-Campbell, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 623 days.

(21) Appl. No.: 16/564,529

(22) Filed: Sep. 9, 2019

(65) Prior Publication Data

US 2021/0068499 A1 Mar. 11, 2021

(51) Int. Cl.

| | |
|---|---|
| ***H05F 3/00*** | (2006.01) |
| ***A43B 13/12*** | (2006.01) |
| ***A43B 3/34*** | (2022.01) |
| ***H05F 3/02*** | (2006.01) |

(52) U.S. Cl.

CPC ..... *A43B 13/122* (2013.01); *A43B 3/34* (2022.01); *H05F 3/00* (2013.01); *H05F 3/02* (2013.01)

(58) Field of Classification Search

CPC ..... A43B 7/36; A43B 13/122; A43B 3/34; H05F 3/00; H05F 3/02

See application file for complete search history.

(56) References Cited

U.S. PATENT DOCUMENTS

| | | | | |
|---|---|---|---|---|
| 6,307,727 | B1 | 10/2001 | DeAngelis et al. | |
| 6,421,222 | B1 * | 7/2002 | Maritz | A43B 13/12 361/224 |
| 6,549,391 | B1 | 4/2003 | Bisson | |
| 7,410,684 | B2 | 8/2008 | McCormick | |
| 7,471,497 | B1 | 12/2008 | Knight, Sr. et al. | |
| 7,997,014 | B2 | 8/2011 | Righetto | |
| 2002/0181183 | A1 * | 12/2002 | Lee | A43B 7/36 361/223 |
| 2010/0165536 | A1 * | 7/2010 | La Rochelle | A43B 7/36 361/220 |
| 2010/0205833 | A1 * | 8/2010 | Wang | A43B 7/36 36/43 |
| 2011/0072689 | A1 | 3/2011 | La Rochelle | |

(Continued)

FOREIGN PATENT DOCUMENTS

WO 2014146278 A1 9/2014

OTHER PUBLICATIONS

Loboda et al., "Electroinsulating Footwear and Overboots for Live Working—Practical Experience and Evolution of Standards," IEEE, 2017 12th International Conference on Live Maintenance (ICOLIM), 2017, 4 pages.

(Continued)

*Primary Examiner* — Scott Bauer
(74) *Attorney, Agent, or Firm* — Nathan M. Rau

(57) ABSTRACT

A shoe may include an upper sole and an outer sole. In one state of the shoe, the upper sole is conductively connected to the outer sole. In another state of the shoe, the upper sole is electrically insulated from the outer sole. The shoe may be changed between these states.

20 Claims, 9 Drawing Sheets

(56) References Cited

U.S. PATENT DOCUMENTS

| | | | |
|---|---|---|---|
| 2012/0078338 | A1 | 3/2012 | Sheraton |
| 2012/0279086 | A1 | 11/2012 | Johnson et al. |

OTHER PUBLICATIONS

"Electrical Hazard (EH) vs Static Dissipative (ESD) and How to Care For ESD Footwear," Coastal Boot, Printed Jul. 30, 2019, 1 page.
"Electrostatic-sensitive device," Wikipedia The Free Encyclopedia, Printed Jul. 30, 2019, 2 pages.
"What are EH-rated shoes?,"SFC B2B Resource Center, Printed Sep. 4, 2019, 3 pages https://www.shoesforcrews.com/worksafety/workplace-footwear/what-are-eh-rated-shoes/.

* cited by examiner

ADAPTIVE ELECTROSTATIC DISCHARGE AND ELECTRIC HAZARD FOOTWEAR

BACKGROUND

The present disclosure relates to footwear, and more specifically, to electrostatic discharge (ESD) and/or electric hazard (EH) footwear.

When working with electronics, specialized equipment is often beneficial or even necessary. For example, sensitive electronics can be damaged by discharge of an electrostatic charge built up on a user's body. This can be alleviated by the user wearing a device designed to dissipate any electrostatic (or other) charge building on the user's body to prevent it from reaching a level that threatens to harm the electronic equipment. Some workspaces provide grounding bracelets to be worn about a user's wrist, while some users prefer to wear specialized footwear to continuously discharge static electricity to the ground.

In addition, some electrical equipment poses an electric shock hazard, often by operating at or with exceedingly high voltages, currents, etc. In this scenario, if a user's body does not provide sufficient resistance, users may run the risk of the equipment discharging dangerous electric currents through the user's body to the ground potentially resulting in serious injury or even death. For example, when a user's hand touches electrical equipment, the user may effectively create an electrical circuit allowing electricity to flow from the equipment to ground via the user's hand, body (potentially across the user's heart), feet and shoe. If there is a path of high resistance from the equipment through the user's body to ground, these shocks will not occur. Thus, this risk can be alleviated through the use of appropriate personal protective equipment (PPE). Such PPE may take the form of electric hazard (EH) footwear, specialized shoes that insulate the wearer from ground, effectively increasing the resistance of a path to ground through the user's body and therefore preventing electrical discharge, through the user's body, to the ground the user is standing on.

In some settings, users must interact with equipment that both operates at or with potentially dangerous electric energy levels and is sensitive to electrostatic discharge. In these scenarios, users often need to prevent buildup of electrostatic charge for one task and protect themselves from dangerous electric shocks for another task.

SUMMARY

Some embodiments of the present disclosure can be illustrated as a shoe. The shoe may include an upper sole and an outer sole. A state of the shoe may be changed between a first state and a second state. The upper sole may be electrically connected to the outer sole in the first state. The upper sole may be electrically insulated from the outer sole in the second state. The shoe can be changed from the first state to the second state. The shoe can be changed from the second state to the first state.

Some embodiments of the present disclosure can also be illustrated as a method. The method may comprise changing a shoe from a first state to a second state. An upper sole of the shoe may be electrically connected to an outer sole of the shoe in the first state. The upper sole may be electrically insulated from the outer sole in the second state. The method may further comprise changing the shoe from the second state to the first state.

The above summary is not intended to describe each illustrated embodiment or every implementation of the present disclosure.

BRIEF DESCRIPTION OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure. Features and advantages of various embodiments of the claimed subject matter will become apparent as the following Detailed Description proceeds, and upon reference to the drawings, in which like numerals indicate like parts, and in which:

Figure 1:
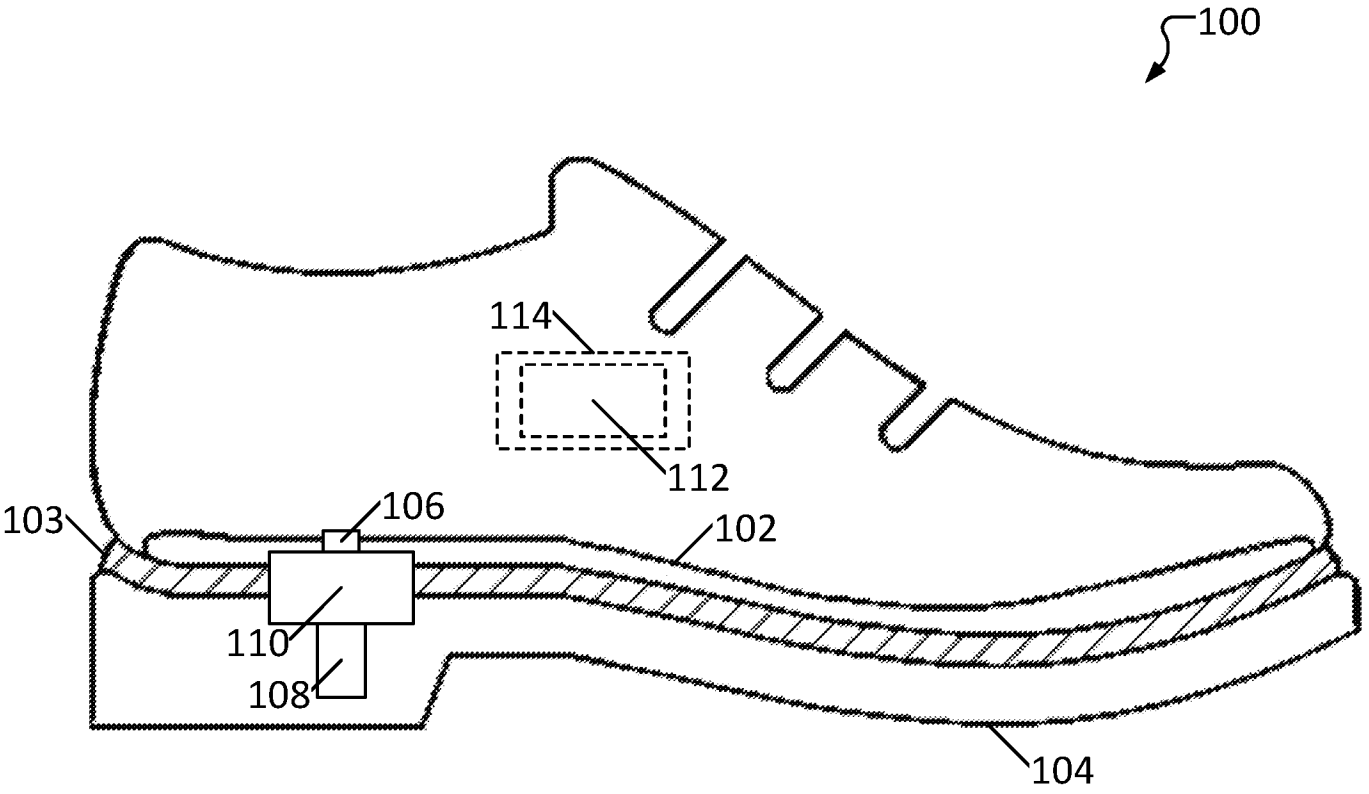
FIG. 1 illustrates a side elevation view of a shoe with an electrical component to control a conductive state of the shoe according to several embodiments of the present disclosure.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

Aspects of the present disclosure relate to an adaptively conductive shoe, more particular aspects relate to a shoe capable of switching from an electrostatic discharge (ESD) state to an electrical hazard (EH) state, and from the EH state to the ESD state. While the present disclosure is not necessarily limited to such applications, various aspects of the disclosure may be appreciated through a discussion of various examples using this context. As a non-limiting example, a shoe consistent with the present disclosure may include an upper sole and an outer sole, and the state of the shoe can be changed between a first state wherein the upper sole is electrically connected to the outer sole and a second state wherein the upper sole is electrically insulated from the outer sole.

Throughout this disclosure, reference is made to one or more "soles." As used herein, "sole" may refer to a layer or component of footwear (such as a shoe) and may generally be configured to be between a wearer's foot and any surface on which the user may be standing when the footwear is worn by the user. Various types of soles are referred to herein. Examples include an "upper sole," which is generally used to refer to an uppermost layer which a wearer's foot (or sock, stocking, or other similar covering thereon) may directly contact (for example, an insole); an "outer sole," which refers to an outermost or bottom layer which makes contact with the surface on which the user may be standing; and a "midsole," which generally refers to a layer positioned between an upper sole and an outer sole. Note that various embodiments may not include discrete soles (e.g., the upper sole, midsole, and outer sole may all be the same continuous object). In these embodiments, the surface that is to make contact with a wearer's foot is considered an "upper sole."

As used herein, "electrically conductive" generally refers to materials and structures that comprise a relatively low electrical resistivity such as, for example, less than 1 Ohm per meter. Non-limiting examples of electrically conductive materials include copper, gold, silver, zinc, and nickel. Thus, a first component that is conductively connected to a second component may mean that a wire or similar electrically conductive element is connected to both the first and second components, allowing electricity to flow between the components with relatively little resistance, as will be understood by those skilled in the art.

Similarly, as used herein, "electrically insulative" or "insulating" generally refers to materials and structures that comprise a relatively high electrical resistivity such as, for example, 1 Ohm per meter or greater. Non-limiting examples of electrically insulative materials include air, rubber, and wood. As will be understood by those skilled in the art, a first component being electrically insulated from a second component may mean that the first component is not connected to the second component by a material with a low electrical resistance.

As used herein, "electrostatic discharge (ESD)" refers to equipment which conductively grounds a wearer, typically enabling electric charge to dissipate over time. Various regulatory entities may have specific standards which equipment must meet before being declared "ESD." While embodiments described herein may meet or exceed these standards, as used herein "ESD" is not intended to be limited to any such standard. Similarly, "electric hazard (EH)" refers to equipment which electrically insulates a wearer, typically preventing or reducing risk of electric shock. Various regulatory entities may have specific standards which equipment must meet before being declared "EH." While embodiments described herein may meet or exceed these standards, as used herein "EH" is not intended to be limited to any such standard.

FIG. 1 illustrates a side elevation view of a shoe 100 with an electrical component 110 to control a conductive state of the shoe 100 according to several embodiments of the present disclosure. The shoe 100 includes an upper sole 102, outer sole 104, upper conductive elements 106, lower conductive elements 108, and electrical component 110. Upper sole 102 is a surface on which a wearer's foot (or sock, etc., not shown) may make contact while wearing shoe 100, such as, for example, an insole, an inside lining of shoe 100, etc. Outer sole 104 is a sole which may make contact with a ground surface, such as a floor, when shoe 100 is worn. Upper conductive elements 106 are configured to conduct electricity from upper sole 102 to electrical component 110. Lower conductive elements 108 are configured to conduct electricity between electrical component 110 and outer sole 104. Electrical component 110 is configured to control a state of shoe 100. For example, in a first state, electrical component 110 may conductively connect upper conductive elements 106 to lower conductive elements 108 such that a foot of a wearer of shoe 100 is electrically grounded. In a second state, electrical component 110 may electrically insulate upper conductive elements 106 from lower conductive elements 108, resulting in a foot of a wearer of shoe 100 being electrically insulated from ground. In general, upper sole 102 is electrically insulated from outer sole 104 with the possible (depending upon state) exception of electrical connector 110.

In some embodiments, electrical component 110 may comprise a mounting slot for a detachable element 112, as described in further detail below. In such embodiments, shoe 100 may further comprise a storage compartment 114 to enable storage of detachable elements 112 for later reuse. Storage compartment 114 may also enable storage of one or more additional detachable elements to serve as, for example, replacements.

As a non-limiting example, in at least one embodiment of FIG. 1, upper sole 102 comprises an insole with an electrically conductive surface (e.g., a surface including copper) such that when a user wears shoe 100, the wearer's foot conductively contacts the copper surface of the insole. Further in this example embodiment, upper conductive elements 106 comprise a first copper wire running through the insole to connect the copper surface of upper sole 102 to electrical component 110. Electrical component 110 may conduct electricity from the upper copper wire to lower conductive elements 108, which in this example comprise a second copper wire. In this embodiment, outer sole 104 comprises a sole of shoe 100 with copper on a bottom surface of sole 104. Lower conductive elements 108 conduct electricity from component 110 to outer sole 104, so in this example embodiment the second copper wire (108) would connect electrical component 110 to the copper on the bottom surface of the sole (104).

In a non-limiting example, in at least one embodiment of FIG. 1, electrical component 110 comprises a switch. When the switch (110) is in a closed position, electricity may flow from a wearer's foot to the insole (102) to the upper copper wire (106) through the switch (110), the lower copper wire (108) and the outer sole (104) to ground. Conversely, when the switch (110) is in an open position, the upper copper wire (106) is insulated from the lower copper wire (108) and therefore the wearer's foot is insulated from ground. Thus, in this embodiment, the switch controls whether or not a wearer's foot is conductively connected to ground or insulated from ground. When the user's foot is connected to ground, shoe 100 may function as an electrostatic discharge shoe. When the user's foot is insulated from ground, shoe 100 may function as an electric hazard shoe. Advantageously, the user may change the functionality of shoe 100 simply by toggling the state of the switch. This may, for example, eliminate a need for users to change shoes, apply or remove an additional coating, etc. while working.

In general, the conductive elements (including upper conductive elements 106 and lower conductive elements 108) may comprise or be selected from a plurality of conductive materials or structures such as, for example, copper wires, insulated cables, conductive strips, etc. In some embodiments, upper conductive elements 106 and lower conductive elements 108 may be primarily internal, meaning they are enclosed within shoe 100 to prevent inadvertent electrical shorts.

In some embodiments, upper conductive elements 106 and lower conductive elements 108 may be at least partially external, meaning at least part of the elements are exposed or are not within the structure of shoe 100 In embodiments wherein the conductive elements are partially external, they may be at least partially shrouded, enclosed, encased, or surrounded in an insulating material such as rubber to prevent inadvertently forming an unintended electrical connection with ground or with objects or surfaces other than ground (e.g., electronic equipment, a chair leg, etc.). This may be beneficial, for example, in case a wearer inadvertently brushes the side of shoe 100 against such objects.

In general, electrical component 110 is configured to enable control and/or manipulate a state of shoe 100. More specifically, electrical component 110 enables control of whether upper conductive elements 106 are conductively connected to lower conductive elements 108. This in turn determines whether upper sole 102 (and thus the body of a wearer of shoe 100) is conductively connected to outer sole 104 (and thus to ground). Thus, electrical component 110 enables control of whether shoe 100 discharges electricity from a user's body (functioning as, for example, an ESD shoe) or insulates a user from potentially dangerous electric shocks (functioning as, for example, an EH shoe).

Electrical component 110 may include, for example, a switch, a fuse, a capacitor, a plurality of circuit elements that may control a state of an electrical connection, or a mounting slot for a detachable conductive or insulative element. When shoe 100 is in a first state, electrical component 110 may conductively connect upper conductive elements 106 to lower conductive elements 108, while when shoe 100 is in a second state, electrical component 110 may electrically insulate upper conductive elements 106 from lower conductive elements 108.

In some embodiments, electrical component 110 may comprise a slot to enable attachment of a removeable electrical element 112, enabling shoe 100 to be changed from a first state to a second state and from the second state to the first state. For example, in at least one embodiment, electrical component 110 comprises a mounting slot such that attaching an electrical element 112 to electrical component 110 closes a circuit between upper conductive elements 106 and lower conductive elements 108, allowing electrical component 110 to conduct electricity from upper sole 102 to outer sole 104. With respect to this example, this may be referred to as a "first state" of shoe 100. As upper sole 102 contacts a wearer's foot (or sock, etc.) when shoe 100 is worn and outer sole 104 may conduct electricity to ground, this may enable shoe 100 to conductively ground a wearer's body and function as an electrostatic discharge (ESD) shoe. In this example, removal of electrical element 112 may break this circuit, disconnecting upper conductive elements 106 from lower conductive elements 108 and thus resulting in upper sole 102 being electrically insulated from outer sole 104. With respect to this example, this may be referred to as a "second state" of shoe 100. In this second state, a wearer's foot may be electrically insulated from ground, which may enable shoe 100 to function as an electric hazard (EH) shoe. In some embodiments, electrical component 112 may be detached and reattached to shoe 100, enabling a wearer to change shoe 100 from the first state to the second state or from the second state to the first state. Thus, shoe 100 may advantageously function as either an ESD shoe or an EH shoe and may be changed switched between the two functionalities.

In this example, when shoe 100 is in this second state, electrical component 110 may be "empty" in that upper conductive elements 106 and lower conductive elements 108 are separated by an air gap. As air is a poor electrical conductor, this may suffice to insulate the wearer's body, depending upon the distance between upper conductive elements 106 and lower conductive elements 108. For example, electrical component 110, when empty, may have a distance between the conductive elements of one inch or greater, two inches or greater, etc.

However, if the distance between the elements is too short or if the wearer encounters a high enough voltage, electricity may still conduct across an air gap, possibly exposing the wearer to a dangerous shock even when shoe 100 is in an insulative state. This may also occur if a conductive object (such as an object in a wearer's work environment or possibly even a conductive electric element) is allowed to connect upper conductive elements 106 to lower conductive elements 108 (such as if the wearer accidentally bumps the shoe into such an object). Thus, in some embodiments, additional electrical elements may be used. For example, a conductive first electrical element may be attached to electrical component 110 to ground a wearer's body and set shoe 100 to a first state. In this example, changing shoe 100 to the second state may comprise removing the first electrical element to break the circuit (as described above) and attaching an insulative second electrical element to electrical component 110 to further insulate the wearer's body. This may increase safety by reducing a risk of an accidental short between upper conductive elements 106 and lower conductive elements 108 that may otherwise result by electricity bridging an air gap or a conductive object being allowed to connect the conductive elements.

In some embodiments, electrical component 110 may be configured to prevent upper conductive elements 106 and/or lower conductive elements 108 from being exposed to air, such as by retracting, sheathing, or otherwise covering the conductive elements. For example, electrical component 110 may include one or more sliding insulative covers. This may prevent accidental connections exposing a wearer to a potentially dangerous shock when shoe 100 is intended to be insulative without requiring the wearer to insert a second electrical element into electrical component 110. In these and other embodiments, electrical element 112 may be configured to, upon insertion into electrical component 110, cause upper conductive elements 106 and lower conductive elements 108 to be exposed. This may be accomplished through a variety of means known to those skilled in the art.

In some embodiments, electrical component 110 may comprise a switch including at least two positions, wherein a first position (e.g., a "down" position) completes a connection between upper conductive elements 106 and lower conductive elements 108, putting shoe 100 into a first state, while a second position (e.g., an "up" position) breaks this connection, resulting in shoe 100 being in a second state. Thus, shoe 100 may similarly advantageously function as either an ESD shoe or as an EH shoe and may be freely switched between the two functionalities.

In at least one embodiment, electrical component 110 may accept insertion of a fuse (for example, electrical element 112 may comprise a fuse) conductively connecting upper conductive elements 106 and lower conductive elements 108, wherein a relatively low current (e.g., 5 mA or less, 10 mA or less, etc.) may be allowed to flow relatively freely, allowing shoe 100 to "trickle discharge" and may therefore function as an ESD shoe. However, a relatively large current may "overload" or "blow" the fuse, breaking the electrical connection entirely. In this way, fuse electrical element 112 may also prohibit a relatively large current (e.g., 1A or greater), thereby protecting a wearer from potentially dangerous electric shocks (i.e., an EH shoe). As such an embodiment grounds a wearer while also protecting from shocks, shoe 100 may function as both an ESD and EH shoe simultaneously, at least until the fuse is blown. After the fuse is blown, shoe 100 may continue to function as an EH shoe, but as upper sole 102 and outer sole 104 will no longer be conductively connected, fuse electrical element 112 will need to be replaced before shoe 100 may resume functioning as an ESD shoe.

In some embodiments, shoe 100 may include midsole 103. Midsole 103 may be configured to insulate upper sole 102 from outer sole 104. For example, midsole 103 may be composed of a material such as rubber, wood, etc. This may prevent electricity from flowing between upper sole 102 and outer sole 104 (and thus between a wearer's body and ground) except when shoe 100 is specifically configured to ground a wearer's body via, for example, electrical component 110. As described above, in some embodiments one or more of upper sole 102, midsole 103, and/or outer sole 104 may comprise different parts, layers or regions of a single structure, while in other embodiments, they may each comprise a distinct component. Various combinations are also possible, as will be understood by those skilled in the art.

Figure 2:
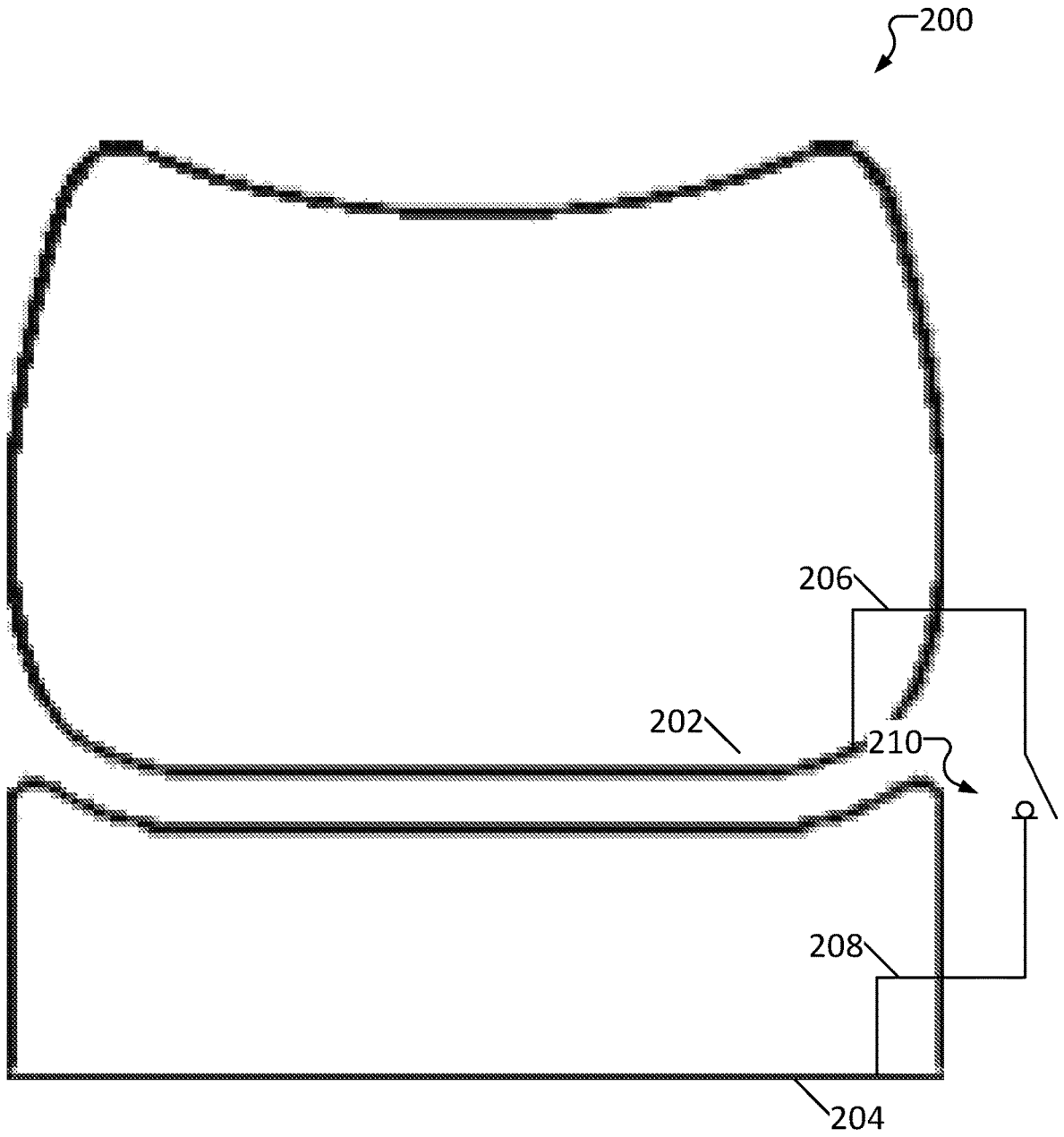
FIG. 2 illustrates a section view of a shoe including a switch to control a conductive state of the shoe according to an embodiment of the present disclosure.

FIG. 2 illustrates a section view of a shoe 200 including a switch 210 to control a conductive state of the shoe 200 according to an embodiment of the present disclosure. Shoe 200 includes upper conductive elements 206 and lower conductive elements 208 to conductively connect upper sole 202 to outer sole 204 depending upon a state of switch 210. Switch 210 may comprise a customer off-the-shelf (COTS) device, such as a toggle switch, sliding switch, radial switch, key-activated switch, etc.

When switch 210 is closed (i.e., conductively connecting an input to an output), upper sole 202 is electrically connected, via upper conductive elements 206, switch 210, and lower conductive elements 208 to outer sole 204. Therefore, when switch 210 is closed, a wearer's body is electrically grounded. Conversely, when switch 210 is open (i.e., when the input is not conductively connected to the output), upper conductive elements 206 are insulated from lower conductive elements 208, thus insulating upper sole 202 from outer sole 204. Therefore, when switch 210 is open, a wearer's body is insulated from ground. As dangerous electric shocks typically travel from a contact point (often a user's hand touching energized equipment) through the user's body to ground (often through the user's foot and shoe), insulating the user's body from ground may prevent such shocks from occurring.

Figure 3A:
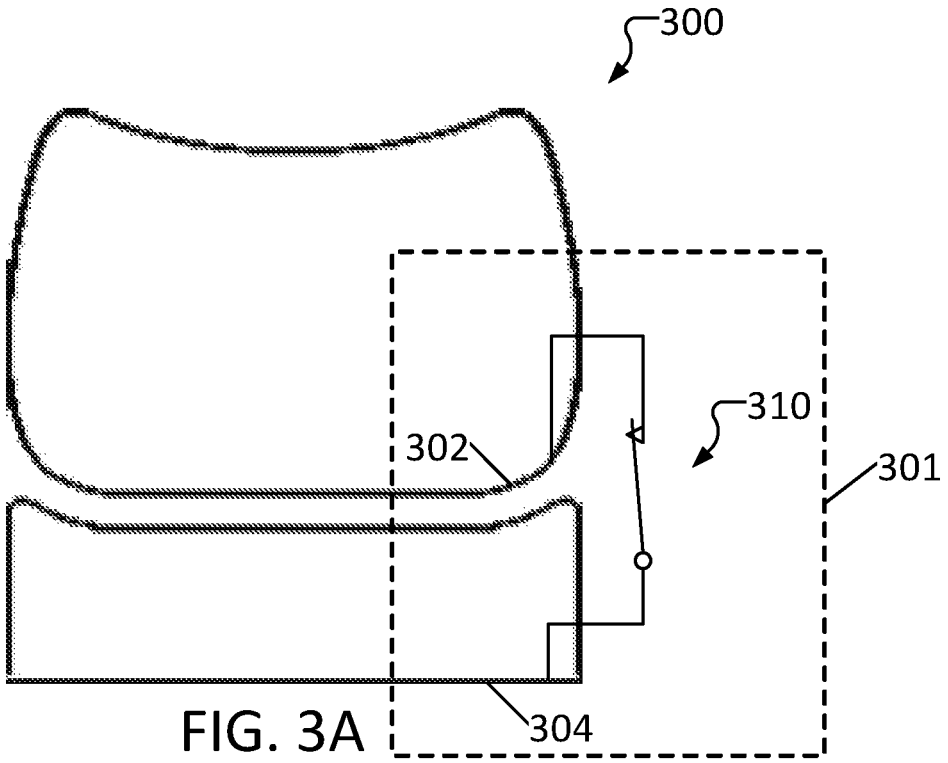
FIG. 3A illustrates a section view of a shoe including a biased switch to control a conductive state of the shoe according to an embodiment of the present disclosure.

FIG. 3A illustrates a section view of a shoe 300 including a biased switch 310 to control a conductive state of the shoe 300 according to an embodiment of the present disclosure. Shoe 300 includes upper sole 302, outer sole 304, upper conductive elements 306, lower conductive elements 308, and electrical component 310 (in this embodiment, a switch). Switch 310 may be biased into a closed position and is depicted as closed in FIG. 3A. For example, switch 310 may include any of a plurality of potential biasing mechanisms, such as springs (translational or torsional), weights, magnets, etc. When switch 310 is in the closed position, upper sole 302 is conductively connected to outer sole 304 via conductive elements 306 and 308. A magnified view of region 301 when switch 310 is in an open position is depicted in FIG. 3B.

Figure 3B:
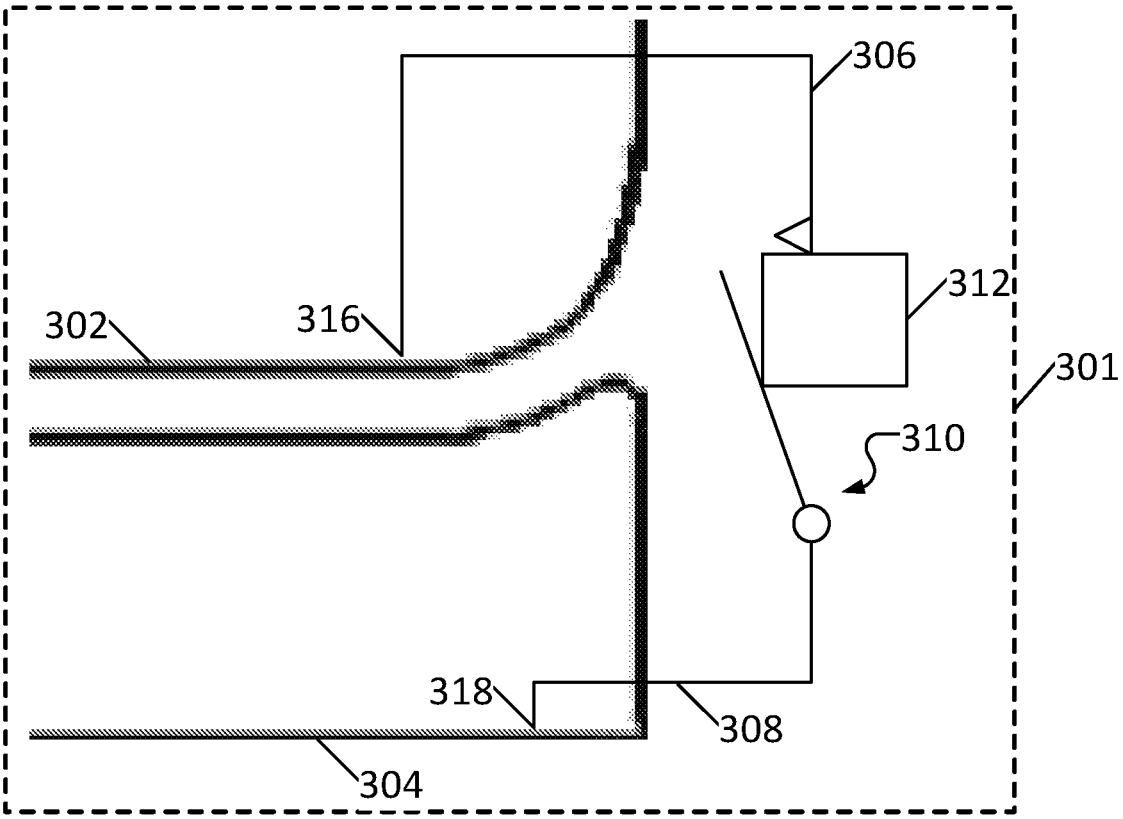
FIG. 3B illustrates a closeup of the section view of 3A, including insertion of an electrical element into the biased switch.

FIG. 3B illustrates a closeup 301 of the section view of FIG. 3A, including insertion of an electrical element 312 into the biased switch 310. As shown in FIG. 3B, switch 310 may be opened via insertion of an electrical element 312. For example, electrical element 312 may be an insulative component such as a rubber insert. When electrical element 312 is inserted into shoe 300, electrical element 312 counteracts the bias of switch 310, forcing switch 310 open and preventing switch 310 from closing. Electrical element 312 may be configured to attach or otherwise securely couple to switch 310 such that electrical element 312 remains in place. In these embodiments, switch 310 may remain in the open position until, for example, a user of shoe 300 intentionally removes electrical element 312.

While electrical element 312 is in place, upper sole 302 is electrically insulated from outer sole 304. This allows shoe 300 to function in an EH state, insulating a user's body from ground and preventing electric shocks. Shoe 300 can quickly and easily be changed into an ESD state simply by removing electrical element 312 and allowing switch 310 to close. In some embodiments, switch 310 may not be biased enough to overcome static friction. For example, switch 310 may include a spring that is not strong enough to close (or open) switch 310 on its own, but will still make it easier for a user to do so. Thus, a user may need to manually close switch 310 after removing electrical element 312 in order to change shoe 300 from an EH state to an ESD state. This may serve as an additional failsafe feature to prevent shoe 300 from unexpectedly becoming conductive if, for example, electrical element 312 falls off of shoe 300 or is knocked out of place.

Shoe 300 may optionally include one or more storage compartments (not shown in FIG. 3) analogous to storage compartment 114 of FIG. 1 to enable storage of electrical element 312 while electrical component 312 is not in use (i.e., while shoe 300 is in an EH state). Of course, additional electrical elements may be provided to serve as replacement electrical elements in case electrical element 312 is lost or damaged, and such additional electrical elements may be stored in the storage compartment(s) as well.

In some embodiments, switch 310 may be biased open rather than closed and configured such that electrical element 312 forces switch 310 to remain closed while electrical element 312 is attached. In at least these embodiments, electrical component 312 may be electrically conductive or insulative, as electricity will be conducted through switch 310 regardless of the composition of electrical component 312. These embodiments may provide additional safety as they further cause shoe 300 to fail into a safe (such as EH) state, in that chances of switch 310 accidentally closing are greatly reduced. For example, even if electrical element 312 is designed to remain in place within switch 310 unless intentionally removed by a user, considerations of accidental removal, dislodge or other loss is still relevant. In embodiments wherein switch 310 is biased open, accidental loss of electrical element 312 will result in switch 310 opening, insulating a wearer of shoe 300 from ground and therefore protecting the wearer from dangerous shocks.

FIG. 3B also depicts upper connection point 316 and lower connection point 318. Upper connection point 316 may represent a location where upper conductive elements 306 conductively connect to upper sole 302. Similarly, lower connection point 318 may represent a location where lower conductive elements 308 conductively connect to outer sole 304.

Figure 4A:
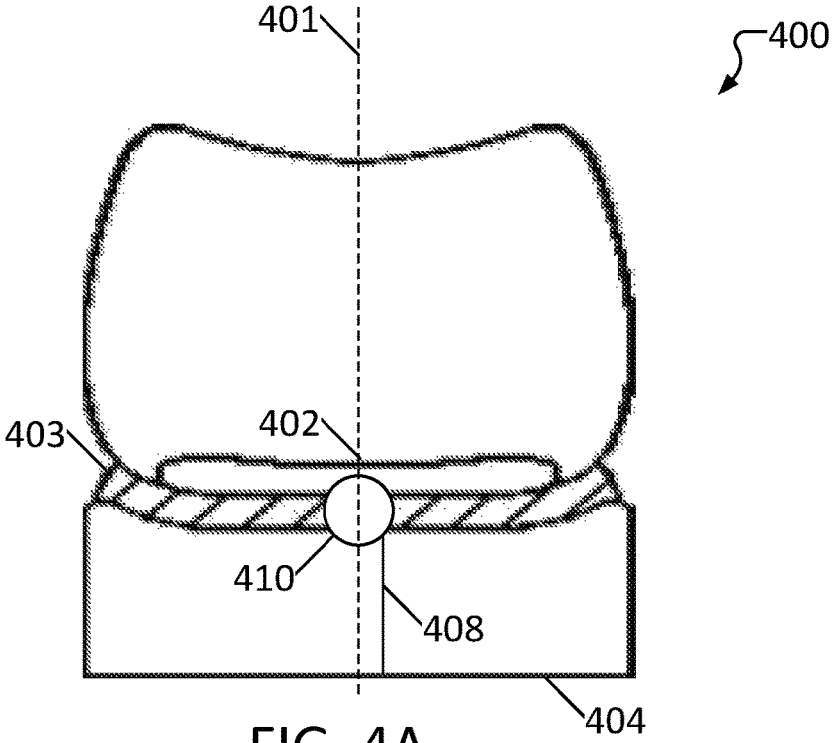
FIG. 4A illustrates a section view of a shoe including a pin slot to control a conductive state of the shoe according to an embodiment of the present disclosure.

FIG. 4A illustrates a section view of a shoe 400 including a pin slot 410 to control a conductive state of the shoe 400 according to an embodiment of the present disclosure. Shoe 400 generally includes insole 402, midsole 403, outer sole 404, lower conductive elements 408 and electrical element 410 (in this embodiment, a pin slot). Notably, shoe 400 does not include specific upper conductive elements analogous to upper conductive elements 106 of FIG. 1. This is because insole 402 is configured to conduct electricity from a wearer's body directly to pin slot 410 without use of intermediate conductive elements such as wires. Outer sole 404 may be configured to conduct electricity from pin slot 410 to ground via lower conductive elements 408. Lower conductive elements 408 may include, for example, wires, cables, conductive strips, etc. Pin slot 410 is configured such that to insole 402 is electrically insulated from outer sole 404 when pin slot 410 is empty.

Figure 4B:
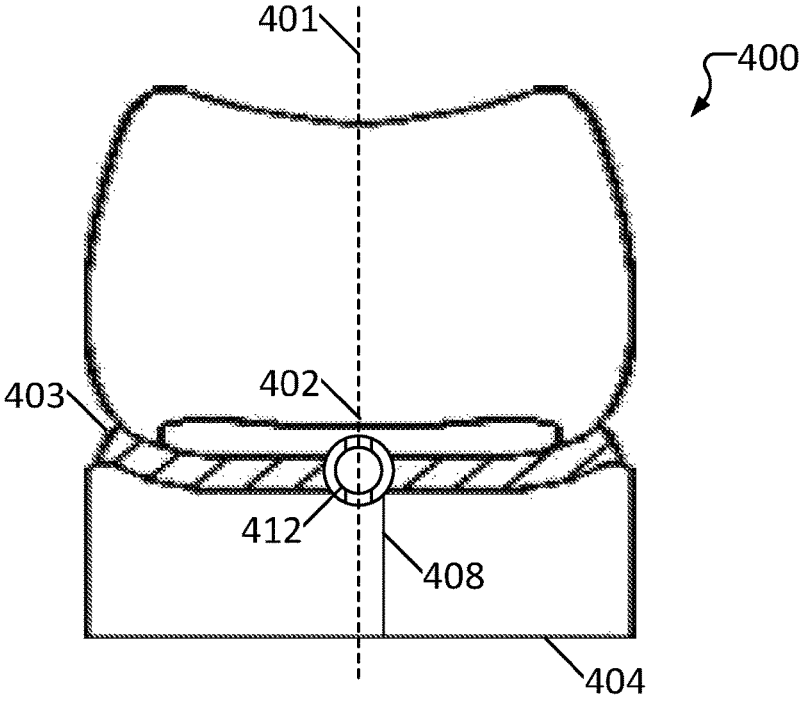
FIG. 4B illustrates a section view of the shoe of FIG. 4A with a pin inserted into the pin slot.

FIG. 4B illustrates a section view of the shoe of FIG. 4A with a pin 412 inserted into the pin slot 410. As shown in FIG. 4B, pin slot 410 is further configured to accept insertion of a pin 412. When pin 412 is inserted into pin slot 410, insole 402 is conductively connected to ground via outer sole 404, enabling shoe 400 to ground a user's body. Pin slot 410 may include two or more conductive surfaces, wherein at least two of the conductive surfaces are electrically insulated from each other.

Figure 4C:
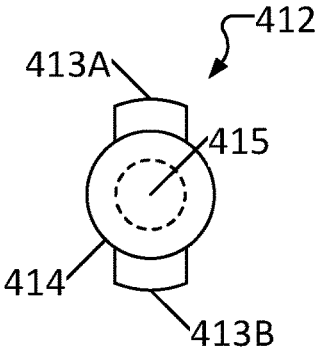
FIG. 4C illustrates an elevation view of the pin of FIGS. 4A and 4B.

FIG. 4C illustrates an elevation view of the pin 412 of FIG. 4B. Pin 412 may include pin head 414 and conductive prongs 413. When pin 412 is inserted into pin slot 410, conductive prongs 413 contact conductive surfaces of pin slot 410. This enables electricity to flow from insole 402 to pin slot 410, through pin 412 to outer sole 404. Insole 402 and/or outer sole 404 may be conductively connected to pin slot 410 via conductive elements such as lower conductive elements 408, or one or both may be in direct conductive contact (for example, as shown in FIGS. 4A and 4B, pin slot 410 may contact insole 402 and at least part of outer sole 404 directly). Pin 412 and/or pin slot 410 may include one or more mechanisms configured to lock or otherwise secure pin 412 in place within pin slot 410. For example, conductive prongs 413 may be extended in their resting state. However, as illustrated in FIG. 4C, pin 412 includes a button 415 that, when depressed, causes conductive prongs 413 to retract into pin 412.

Figure 4D:
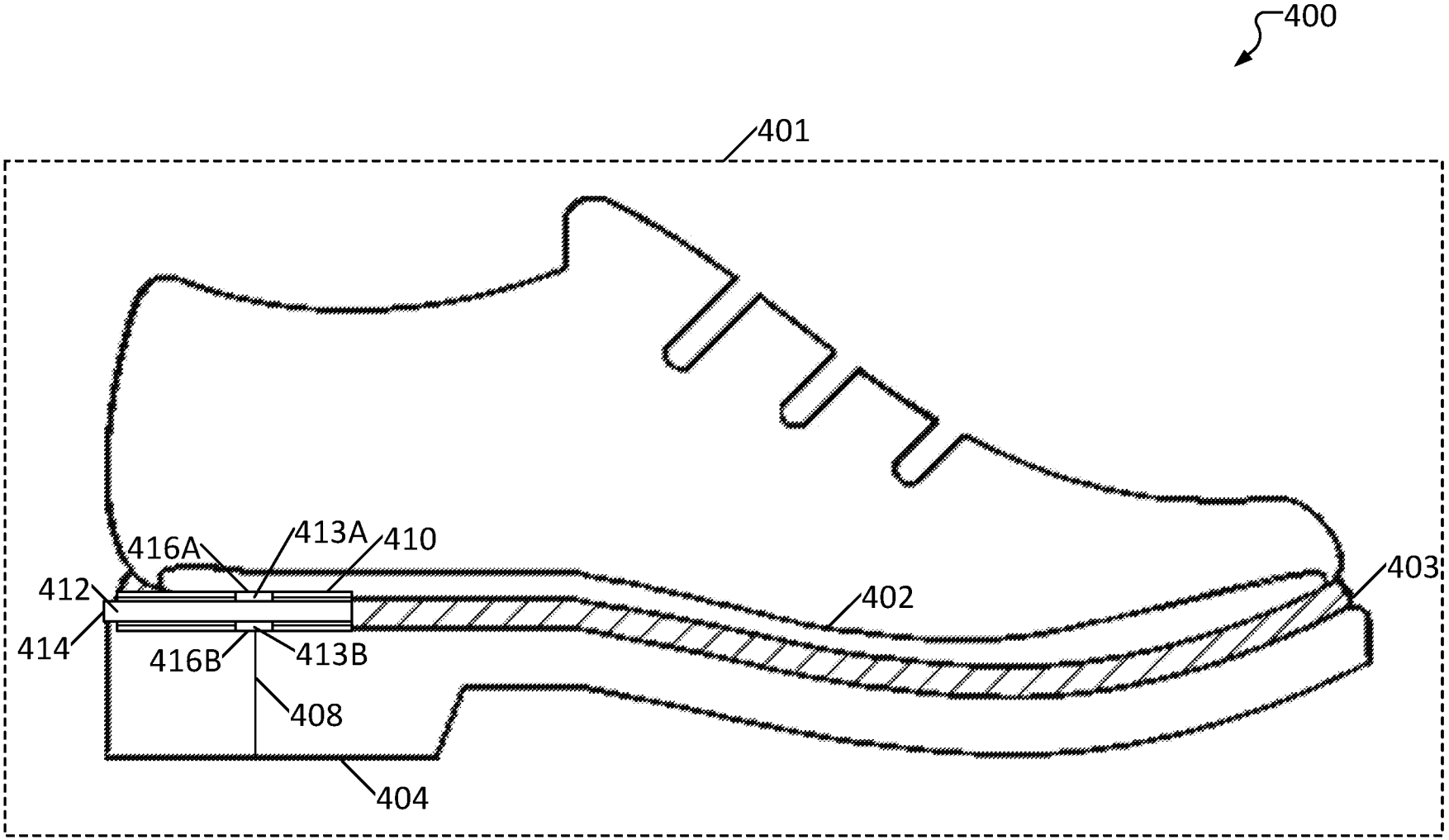
FIG. 4D illustrates a section view of the shoe of FIGS. 4A and 4B with a pin inserted into the pin slot.

FIG. 4D illustrates a section view of the shoe 400 of FIGS. 4A and 4B cut along surface 401 with a pin 412 inserted into the pin slot 410. The upper and lower conductive surfaces 416A, 416B of pin slot 410 may be recessed to allow conductive prongs 413 to be biased into these slots, securing pin 412 into pin slot 410 unless and until button 415 (not shown in FIG. 4D) is depressed. Once button 415 is depressed, conductive prongs 413 are retracted into pin 412, allowing a user to extract pin 412 from pin slot 410. With pin 412 in place within pin slot 410, shoe 400 conducts electricity from the body of the person wearing shoe 400 to ground via insole 402, an upper conductive surface 416A of pin slot 410, an upper conductive prong 413A of pin 412, through pin 412, a lower conductive prong 413B of pin 412, a lower conductive surface 416B of pin slot 410, lower conductive elements 408, and outer sole 404. This enables shoe 400 to serve as an ESD shoe. When pin 412 is removed, this conductive path is broken between upper conductive surface 416A and lower conductive surface 416B, so shoe 400 may function in an EH state by insulating the body of the wearer from ground, reducing the risk of electric shock. Due to the simple but reliable means by which pin 412 can be inserted, secured, and removed, shoe 400 can advantageously be changed from an EH state to an ESD state and back to an EH state at will.

FIG. 4A through 4D depict one possible means of securing pin 412 into pin slot 410, that being biased prongs. Other possibilities are fully considered herein, including but not limited to a securing strap around pin head 414, magnetic components within pin 412 and pin slot 410 to bias pin 412 into pin slot 410, a sliding lock, etc. Combinations of these methods are also possible and fully considered herein.

Figure 5:
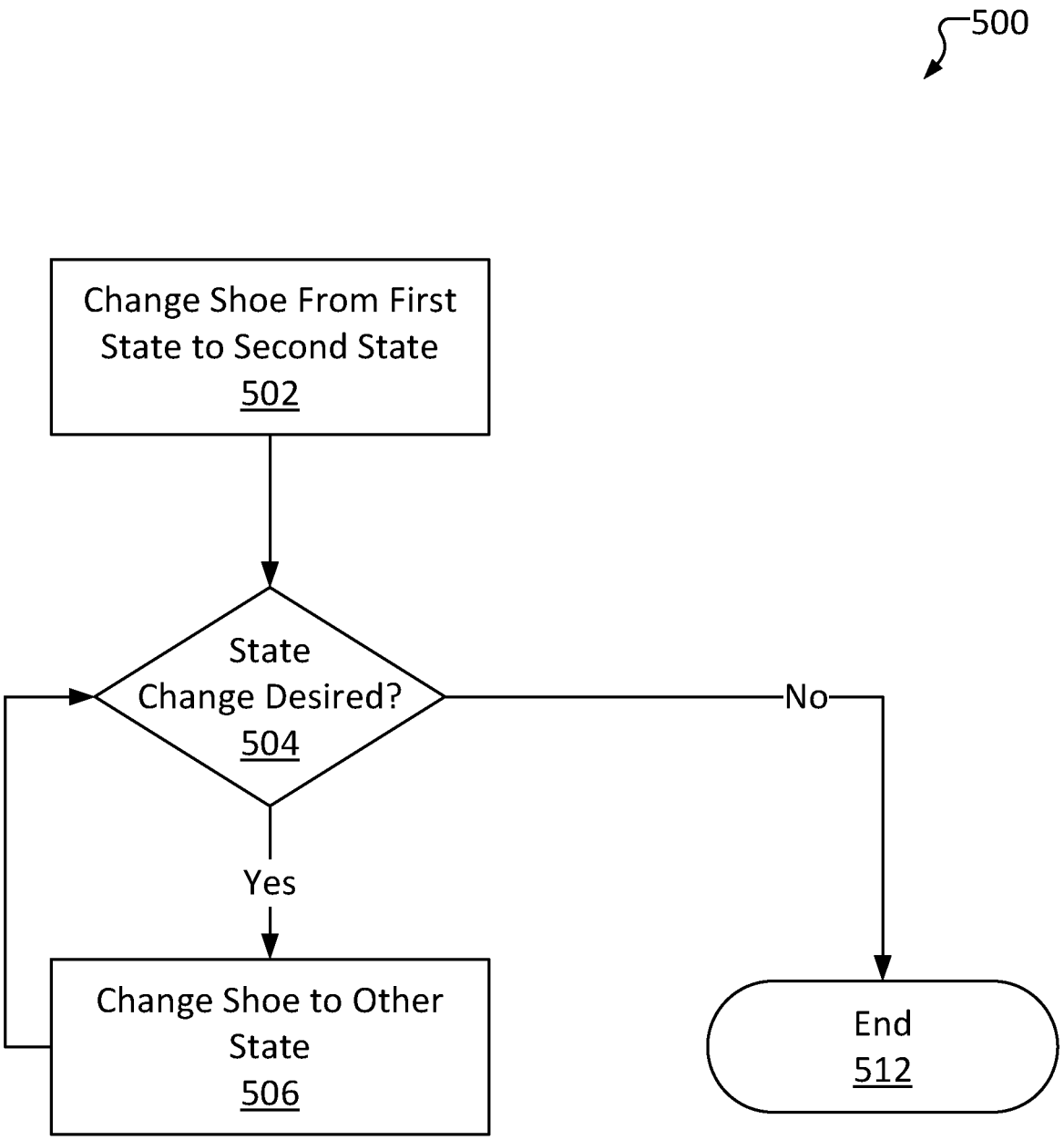
FIG. 5 illustrates operations according to an embodiment of the present disclosure.

FIG. 5 illustrates operations 500 according to an embodiment of the present disclosure. Operations include changing a shoe from a first state to a second state 502. This may include, for example, toggling a position of a switch (as depicted in FIG. 2 or 3) or inserting or removing an electronic component (such as a conductive connector or insulator in FIG. 1 or a pin with prongs as shown in FIGS. 4A, 4B and 4D). In at least one embodiment, changing from a first state to a second state includes triggering/"blowing" or simply removing a fuse. Operations may further include determining if a change in state is desired 504. This may include, for example, a wearer of a shoe determining whether he or she desires the shoe to be in an ESD state when the shoe is in an EH state, or desires the shoe to be in an EH state when the shoe is in an ESD state. This determination may be made based on a variety of factors, including nature of equipment a wearer is currently working with or intends to work with, a work environment, safety considerations, etc. Responsive to a determination that a change in state is desired (i.e., 504 "yes"), operations further include changing the shoe from the second state to the first state 506. This may include, for example, reversing operation 502 (such as toggling a switch back to a previous position, removing or inserting an electronic component, etc.). In some embodiments, this may include replacing or inserting a fuse. Operations may then include determining whether a further state change is desired 504. Responsive to a determination that a state change is not desired (i.e., 504 "no"), operations may end 508.

Figure 6:
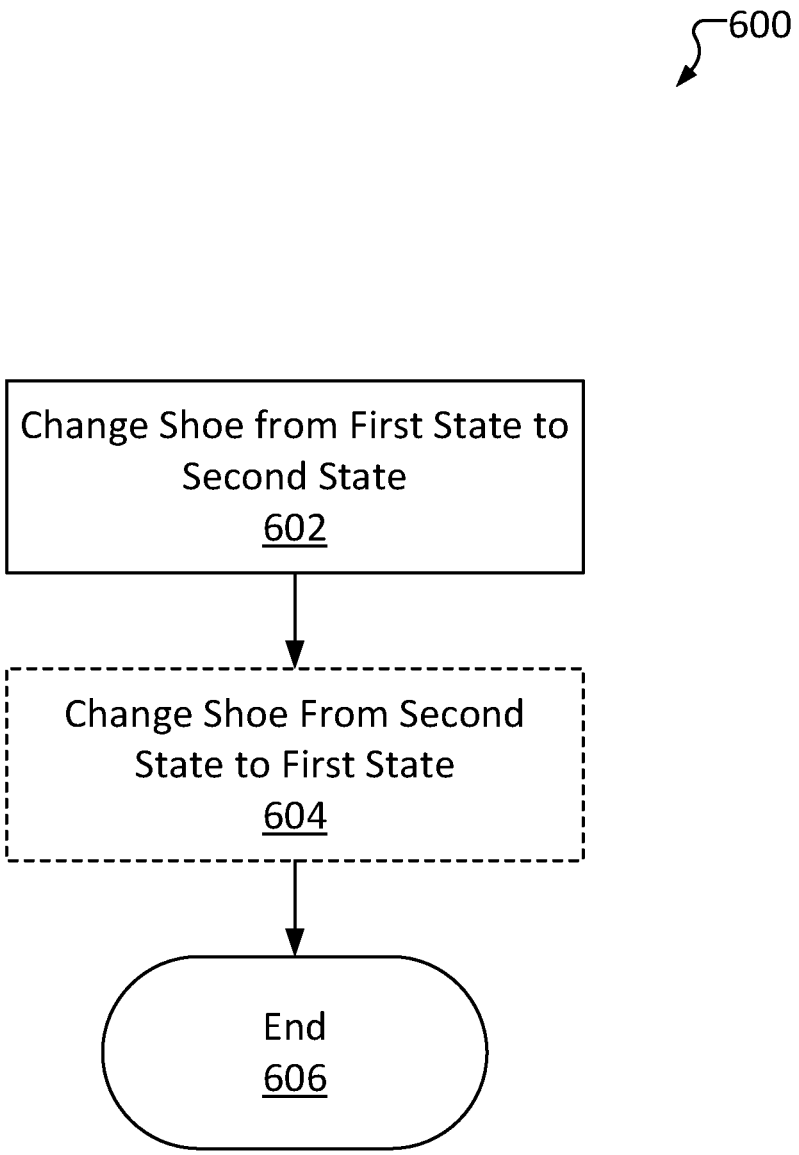
FIG. 6 illustrates operations according to an embodiment of the present disclosure.

FIG. 6 illustrates operations 600 according to an embodiment of the present disclosure. Operations include changing a shoe from a first state to a second state 602. This may include, for example, toggling a position of a switch (as depicted in FIG. 2 or 3) or inserting or removing an electronic component (such as a conductive connector or insulator in FIG. 1 or a pin with prongs as shown in FIGS. 4A, 4B and 4D). In at least one embodiment, this includes triggering/"blowing" or simply removing a fuse. Operations may further include changing the shoe from the second state to the first state 604. This may include, for example, reversing operation 602 (such as toggling a switch back to a previous position, removing or inserting an electronic component, etc.). In some embodiments, this may include replacing or inserting a fuse. Operations then end 606.

Figure 7:
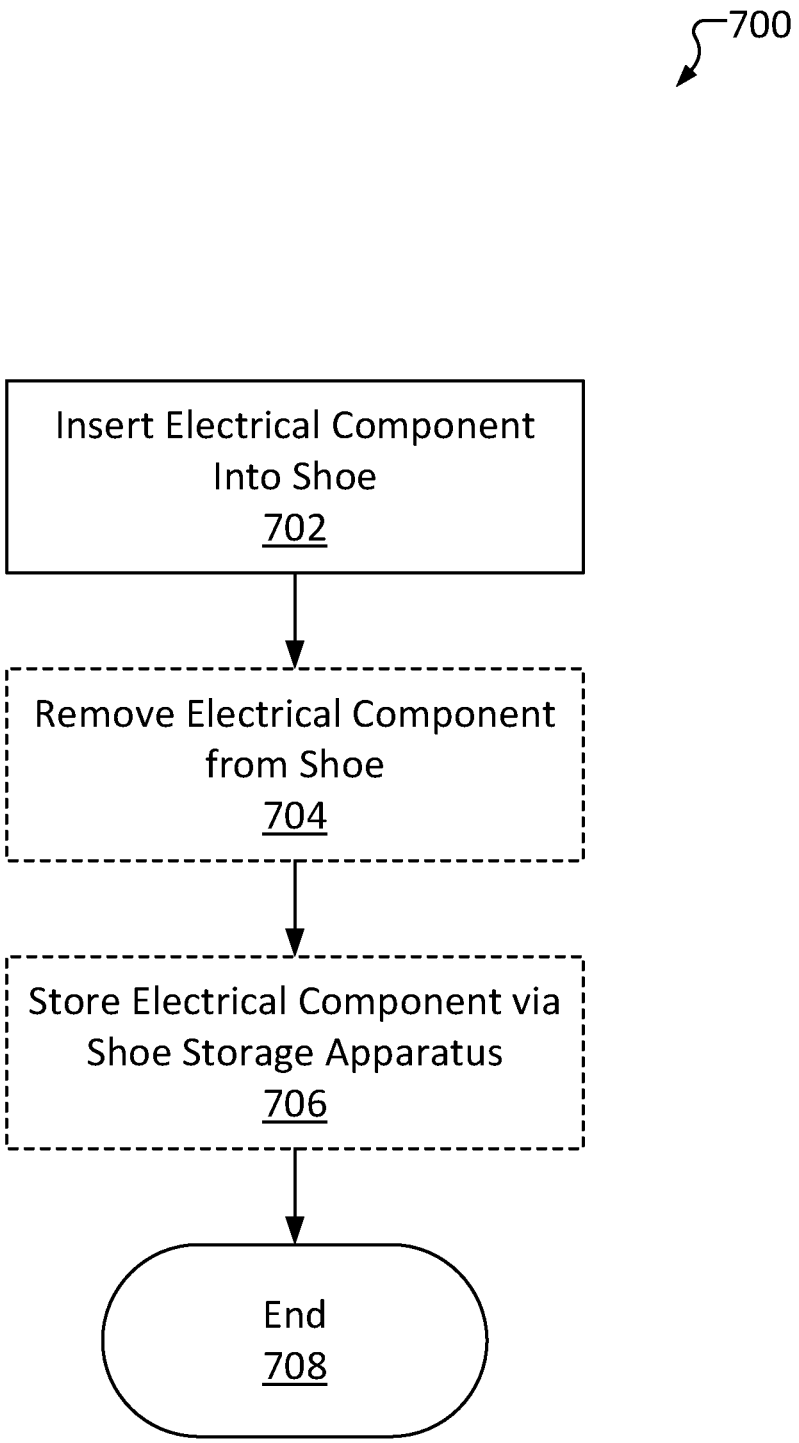
FIG. 7 illustrates operations according to an embodiment of the present disclosure.

FIG. 7 illustrates operations 700 according to an embodiment of the present disclosure. Operations include inserting an electrical component into a shoe 702. This may include, for example, inserting a conductive connector or insulator as in FIG. 1 or a pin with prongs as shown in FIGS. 4A, 4B and 4D). This may change or set a state of the shoe to a particular state, such as an ESD state or EH state. Operations may further include removing the electrical component from the shoe 704. This may change or set the state of the shoe to a different state than the shoe was in previously (i.e., after operation 702). In some embodiments, operations may further include storing the electrical component in a shoe storage compartment 706. This may include, for example, storing electrical element 112 in storage compartment 114 as shown in FIG. 1. Operations may then end 708.

Figure 8:
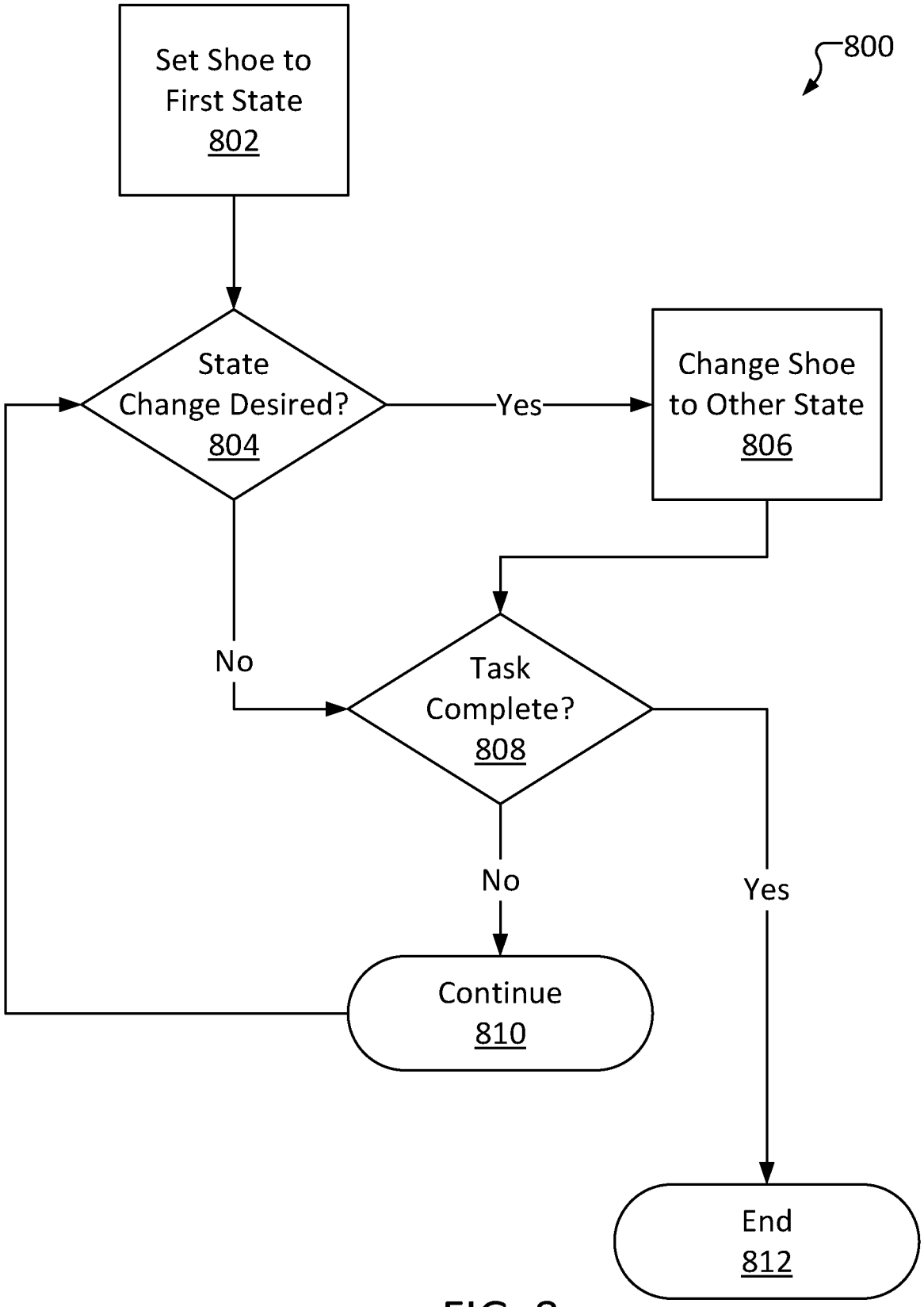
FIG. 8 illustrates operations according to an embodiment of the present disclosure.

FIG. 8 illustrates operations 800 according to an embodiment of the present disclosure. Operations include setting a shoe to a first state 802. This may include, for example, toggling a position of a switch (as depicted in FIG. 2 or 3) or inserting or removing an electronic component (such as a conductive connector or insulator in FIG. 1 or a pin with prongs as shown in FIGS. 4A, 4B and 4D). In at least one embodiment, this includes triggering/"blowing" or simply removing a fuse. Operations may further include determining if a change in state is desired 804. This may include, for example, a wearer of a shoe determining whether he or she desires the shoe to be in an ESD state when the shoe is in an EH state or desires the shoe to be in an EH state when the shoe is in an ESD state. This determination may be made based on a variety of factors, including nature of equipment a wearer is currently working with or intends to work with, a work environment, safety considerations, etc. Responsive to a determination that a change in state is desired (i.e., 804 "yes"), operations further include changing the shoe from the current state to a different state (e.g., from the first state to a second state) 806. This may include, for example, reversing operation 802 (such as toggling a switch back to a previous position, removing or inserting an electronic component, etc.). In some embodiments, this may include replacing or inserting a fuse. Operations may then include determining whether a task is complete 808. This task may comprise, for example, a task that a wearer of the shoe is performing, such as soldering work on sensitive electronic equipment, maintenance on high-power electronic equipment, etc. Responsive to a determination that the task is not yet complete (i.e., 808 "no"), operations include continuing work on the task 810, and determining whether an additional state change is desired 804. Responsive to a determination that a state change is not desired and/or necessary (i.e., 804 "no"), operations proceed to determining whether the task is complete 808. Responsive to a determination that the task is complete (i.e., 808 "yes"), operations may end 812.

ESD footwear and EH footwear have typically been considered incompatible; ESD is designed to conduct a user's body to ground, while EH is designed to insulate it. Thus, to address both issues, users often utilize insulative EH covers meant to be wrapped around ESD shoes when dealing with potential danger, removing the cover when ESD functionality is desired. In some cases, users even switch shoes from an ESD pair to an EH pair (or vice versa) depending upon the task at hand. The systems and methods in the present disclosure advantageously provide a solution to this by providing a shoe that can be reconfigured between an insulative and a conductive state.

The present invention may be an apparatus, a system, and/or a method at any possible technical detail level of integration. Aspects of the present invention are described herein with reference to flowchart illustrations and/or block diagrams of methods and apparatus (systems). The flowchart and block diagrams in the Figures illustrate the architecture, functionality, and operation of possible implementations of systems and method according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be accomplished as one step, executed concurrently, substantially concurrently, in a partially or wholly temporally overlapping manner, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to explain the principles of the embodiments, the practical application or technical improvement over technologies found in the marketplace, or to enable others of ordinary skill in the art to understand the embodiments disclosed herein.

What is claimed is:

1. A shoe, comprising:

an upper sole; and an outer sole, wherein a state of the shoe can be changed by a user between a first state and a second state, wherein:

the upper sole is electrically connected to the outer sole in the first state;

the upper sole is electrically insulated from the outer sole in the second state;

the shoe can be changed by the user from the first state to the second state; and the shoe can be changed by the user from the second state to the first state.

2. The shoe of claim 1, further comprising:

an electrical component to control the state of the shoe; and a first electrical element, wherein:

attaching the first electrical element to the electrical component changes the state of the shoe from the first state to the second state; and detaching the first electrical element from the electrical component changes the state of the shoe from the second state to the first state.

3. The shoe of claim 2, wherein the first electrical element comprises an electrically conductive element.

4. The shoe of claim 2, wherein the first electrical element comprises an electrically insulating element.

5. The shoe of claim 2, further comprising a storage compartment to enable storage of the first electrical element.

6. The shoe of claim 2, wherein the first electrical element comprises a fuse.

7. The shoe of claim 2, further comprising a second electrical element, wherein:

detaching the second electrical element from the electrical component and attaching the first electrical element to the electrical component changes the state of the shoe from the first state to the second state; and detaching the first electrical element from the electrical component and attaching the second electrical element to the electrical component changes the state of the shoe from the second state to the first state.

8. The shoe of claim 1, further comprising a switch to control the state of the shoe.

9. The shoe of claim 8, further comprising an electrically insulative element, wherein:

the shoe is in the first state when the switch is closed; and attaching the electrically insulative element to the shoe opens the switch and changes the shoe from the first state to the second state.

10. The shoe of claim 9, wherein the switch is biased into a closed position.

11. The shoe of claim 9, wherein the switch is biased into an open position.

12. A method, comprising:

changing, by a user, a shoe from a first state to a second state, wherein an upper sole of the shoe is electrically connected to an outer sole of the shoe in the first state and wherein the upper sole is electrically insulated from the outer sole in the second state; and changing, by the user, the shoe from the second state to the first state.

13. The method of claim 12, wherein:

changing the shoe from the first state to the second state comprises inserting a first electrical element into the shoe; and changing the shoe from the second state to the first state comprises removing the first electrical element from the shoe.

14. The method of claim 13, wherein:

changing the shoe from the first state to the second state further comprises removing a second electrical element from the shoe; and changing the shoe from the second state to the first state further comprises inserting the second electrical element into the shoe.

15. The method of claim 12, wherein:

changing the shoe from the first state to the second state comprises removing a first electrical element from the shoe; and changing the shoe from the second state to the first state comprises inserting the first electrical element into the shoe.

16. The method of claim 15, wherein:

changing the shoe from the first state to the second state further comprises inserting a second electrical element into the shoe; and changing the shoe from the second state to the first state further comprises removing the second electrical element from the shoe.

17. The method of claim 12, wherein:

changing the shoe from the first state to the second state comprises setting a switch to a first position; and changing the shoe from the second state to the first state comprises setting the switch to a second position.

18. The method of claim 17, wherein setting the switch to the first position includes attaching an electrical element to the shoe.

19. The method of claim 18, wherein setting the switch to the second position includes removing the electrical element from the switch.

20. The method of claim 12, wherein changing the shoe from the second state to the first state comprises inserting a fuse into the shoe.

* * * * *